US006969051B1

(12) United States Patent
Gibbs

(10) Patent No.: US 6,969,051 B1
(45) Date of Patent: Nov. 29, 2005

(54) TWO-PART RAIL WITH INTERNAL PICKET CONNECTION

(76) Inventor: Edward L. Gibbs, 1555 N. Mingo Rd., Tulsa, OK (US) 74116

( * ) Notice: Subject to any disclaimer, the term of this patent is extended or adjusted under 35 U.S.C. 154(b) by 101 days.

(21) Appl. No.: 10/302,501

(22) Filed: Nov. 22, 2002

(51) Int. Cl.[7] ..... E04H 17/16
(52) U.S. Cl. ..... 256/65.01; 256/19; 256/21
(58) Field of Search ..... 256/19, 21, 22, 256/59, 65.01, 65.02, 65.03, 65.04, 65.05

(56) References Cited

U.S. PATENT DOCUMENTS

| | | | | |
|---|---|---|---|---|
| 3,522,933 | A * | 8/1970 | Braun | 256/22 |
| 5,136,813 | A | 8/1992 | Gibbs et al. | |
| 5,272,838 | A | 12/1993 | Gibbs | |
| 5,345,723 | A | 9/1994 | Gibbs | |
| 5,443,244 | A | 8/1995 | Gibbs | |
| 5,454,548 | A * | 10/1995 | Moore | 256/22 |
| 5,967,498 | A * | 10/1999 | Junell | 256/19 |
| 5,971,365 | A | 10/1999 | Pigott et al. | |
| 6,151,772 | A | 11/2000 | Pigott et al. | |
| 6,176,043 | B1 | 1/2001 | Gibbs | |
| 6,254,064 | B1 | 7/2001 | Gibbs | |

FOREIGN PATENT DOCUMENTS

| | | | |
|---|---|---|---|
| GB | 2249327 | A1 | 5/1992 |
| GB | 2350846 | A1 | 12/2000 |
| GB | 2363400 | A1 | 12/2001 |
| GB | 2372758 | A1 | 9/2002 |
| GB | 2372759 | A1 | 9/2002 |
| WO | WO 95/33113 | A1 | 12/1995 |
| WO | WO 02/70838 | A1 | 9/2002 |

OTHER PUBLICATIONS

Catalog, Ameristar Fence Products, Inc., "Aegis Ornamental Steel Residential Fencing," all pages, published in the United States no later than Apr., 2001.

Catalog, Ameristar Fence Products, Inc., "Aegis II Industrial & Aegis Plus Commercial Ornamental Steel Fence and TransPort Ornamental Gates," all pages, published in the United States in public uses and sales described in Information Disclosure Statement.

* cited by examiner

*Primary Examiner*—John R. Cottingham
(74) *Attorney, Agent, or Firm*—Gary Peterson

(57) ABSTRACT

A two-part rail is formed from a channel element which includes internal runners and stops which form a tray holder. A separate tray element may slide into the channel element, where it is supported on and confined by the tray holder. The tray element and channel element define boundaries of a retainer channel. Pickets traversed by alignable retainer passages are inserted through registering picket openings in the channel and tray elements of a rail. The pickets are secured to the rail by inserting a rod-like retaining element into the retainer channel of the rail and through the aligned retainer passages of the pickets.

30 Claims, 5 Drawing Sheets

26
35
35
35
32
30
35
34
35
3
3
28
62
62
62
58
56
62
60
62
5
5
110
112
104

TWO-PART RAIL WITH INTERNAL PICKET CONNECTION

FIELD OF THE INVENTION

The present invention relates generally to rails, and more particularly to rails used in fences and other barriers.

SUMMARY OF THE INVENTION

The rail of the present invention comprises a channel element which features a platform having opposed first and second lateral edges, a first side wall which depends from the first lateral edge of the platform, and a second side wall which depends from the second lateral edge of the platform. The platform and the first and second side walls define boundaries of a rail channel. The channel element further comprises a tray holder adapted to slidably support a tray element within the rail channel, while restricting its movement toward or away from the platform. The rail may further comprise a tray element supportable on the tray holder in an installed position within the channel element, with the tray element and the channel element defining boundaries of a retainer channel.

The present invention further comprises a fence comprising a plurality of the above-described rails and a plurality of vertically disposed posts. Each adjacent pair of posts supporting the opposite ends of a plurality of rails. The fence further comprises a plurality of pickets, with each picket being laterally traversed by at least one retainer passage. The fence further comprises an elongate retainer element which is positioned within the retainer channel such that it passes through the aligned retainer passages of the pickets.

The present invention further comprises a kit comprising a plurality of the above-described rails, and further comprising a plurality of posts and a plurality of pickets.

The present invention further comprises a method of making the above-described rail, comprising forming the channel element from an extrudable material by an extrusion process, and forming the tray element from an extrudable material by an extrusion process.

The present invention further comprises a method of assembling the above-described fence, comprising installing a plurality of pickets into a rail, such that their retainer passages are aligned. A retainer element is then inserted into the retainer channel, and through the aligned retainer passages of the installed pickets. These steps are repeated for each additional rail which will support the pickets. Each rail is then secured at its opposite ends to an adjacent pair of posts.

BRIEF DESCRIPTION OF THE DRAWINGS

FIG. 6 is a cross-sectional view of the rail of the present invention in an assembled state, showing the tray element installed within the channel element.

FIG. 8 is a front elevational view of a section of a fence, the upper rail of which comprises another embodiment of the rail of the present invention. The section has been shown fragmentarily to indicate indeterminate length. The supporting terrain and substrates are shown in cross section.

FIG. 9 is a top plan view of the upper rail shown in FIG. 8.

DETAILED DESCRIPTION

Figure 1:
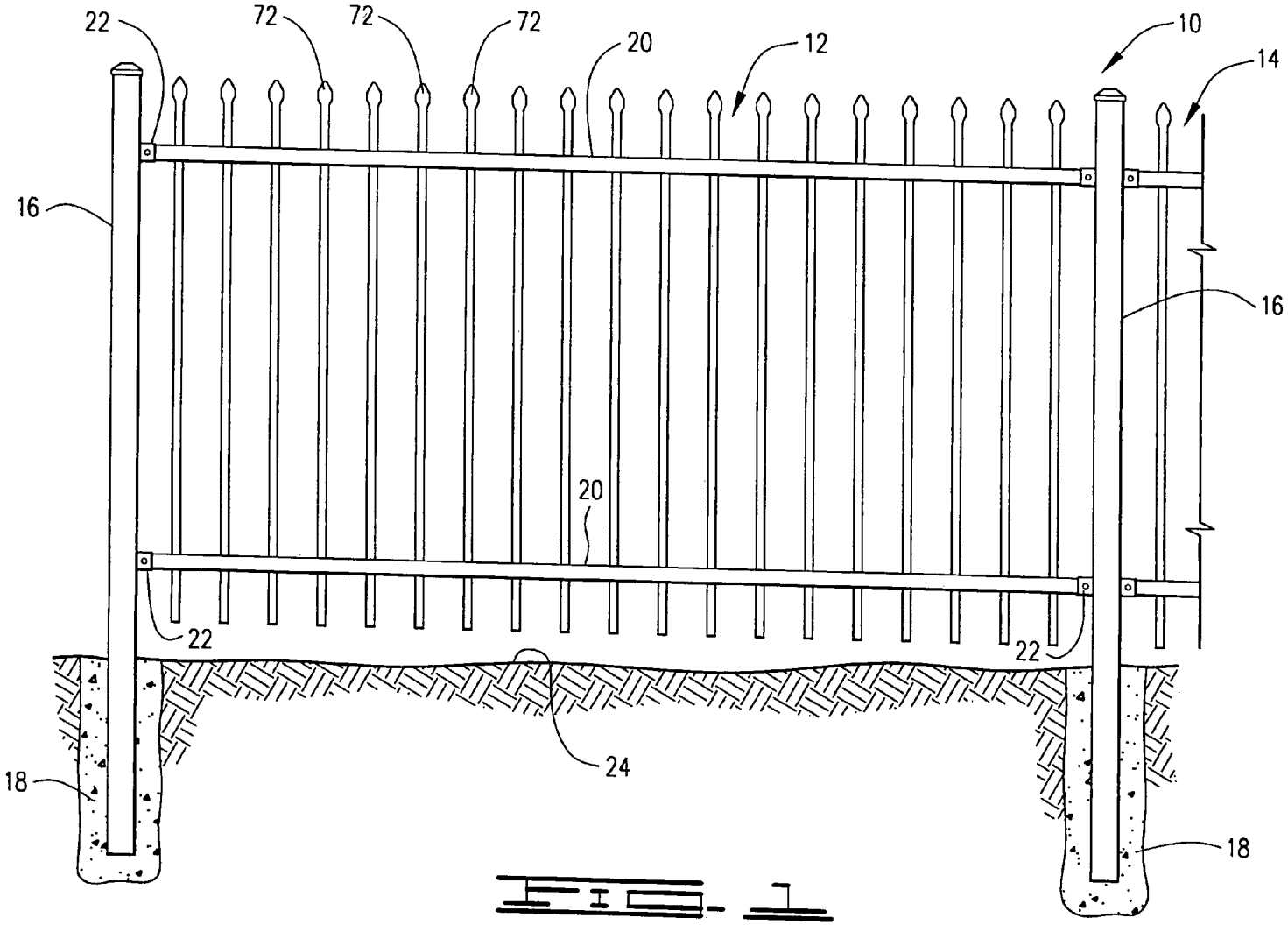
FIG. 1 is a front elevational view of a section of a fence formed from the rail of the present invention. The section has been shown fragmentarily to indicate indeterminate length. The supporting terrain and substrates are shown in cross section.

With reference to FIG. 1, the present invention comprises a fence, generally designated by reference numeral 10. The fence 10 preferably comprises a plurality of adjacent sections, such as the sections 12 and 14. Each section comprises a pair of adjacent vertical posts 16. Preferably, the fence 10 is configured so that the same single post 16 may be shared by two adjacent sections, as shown in FIG. 1.

Preferably, the posts 16 are of identical construction. Each of the posts 16 is securely anchored at its lower portion into a substrate 18, such as an underground mass of concrete. The substrates 18 are preferably disposed in spaced relationship, with a separate substrate preferably supporting each post 16. The posts 16 are situated along the boundary of the area to be enclosed by the fence 10, with a post spacing which is adequate to impart strength to the fence 10 and to securely anchor other fence components. In one preferred embodiment, adjacent posts comprising a section are separated by a distance of no greater than 8 feet.

The above-ground height of each post 16, in its installed configuration, is preferably sufficient to impede or deny access by a human or other intruder. In preferred embodiments, the above-ground height of each post 16 is between 3 and 10 feet. The upper end of each post 16 may be provided with a round top, as shown in FIG. 1. Alternately, a flat post top may be used, or a top which has been formed into pointed or sharpened configuration, such as a spear or spike.

Each of the posts 16 is preferably formed from a strong and durable material, and more preferably from a material which is relatively lightweight and extrudable as well. Preferred materials include aluminum, aluminum alloys, and plastics such as polyvinyl chloride. One particularly preferred material is 6005-T5 aluminum alloy. Preferably, the post 16 is formed in a die by an extrusion process. After the post 16 has been formed, a polyester powder coating is preferably provided in order to enhance corrosion resistance of the post.

The post 16 is tubular in construction, and preferably is characterized by a rectangular, and more preferably, a square cross-section. The post 16 may be hollow, or may include a core or other structure to increase its strength. In a preferred embodiment, the post 16 is characterized by an internal wall which interconnects two opposing side walls of the post 16, thereby defining a double box cross-sectional structure. In a preferred embodiment, the side walls of the post 16 are characterized by a thickness of 0.06 inches or more, and a width of between 2.5 and 4 inches.

With continued reference to FIG. 1, each section of the fence 10 further comprises a plurality of elongate rails 20. Each rail 20 is preferably formed from two separate and discrete components: a channel element 26, shown in FIGS. 2 and 3; and a tray element 28, shown in FIGS. 4 and 5. Each of these components of the rail 20 is preferably formed from a strong and durable material, and more preferably from a material which is relatively lightweight and extrudable as well. Preferably, each component of the rail 20 is separately formed in a die by an extrusion process. After a rail component has been formed, a polyester powder coating is preferably provided in order to enhance the component's corrosion resistance.

The present invention is well-adapted to rails formed from materials which are not readily susceptible to conventional roll forming, such as aluminum and its alloys. Preferred materials for the rail 20 include aluminum, aluminum alloys, and plastics such as polyvinyl chloride. Particularly preferred materials are 6005-T5 aluminum alloy (for channel elements) and 6063-T5 aluminum alloy (for tray elements).

Figure 2:
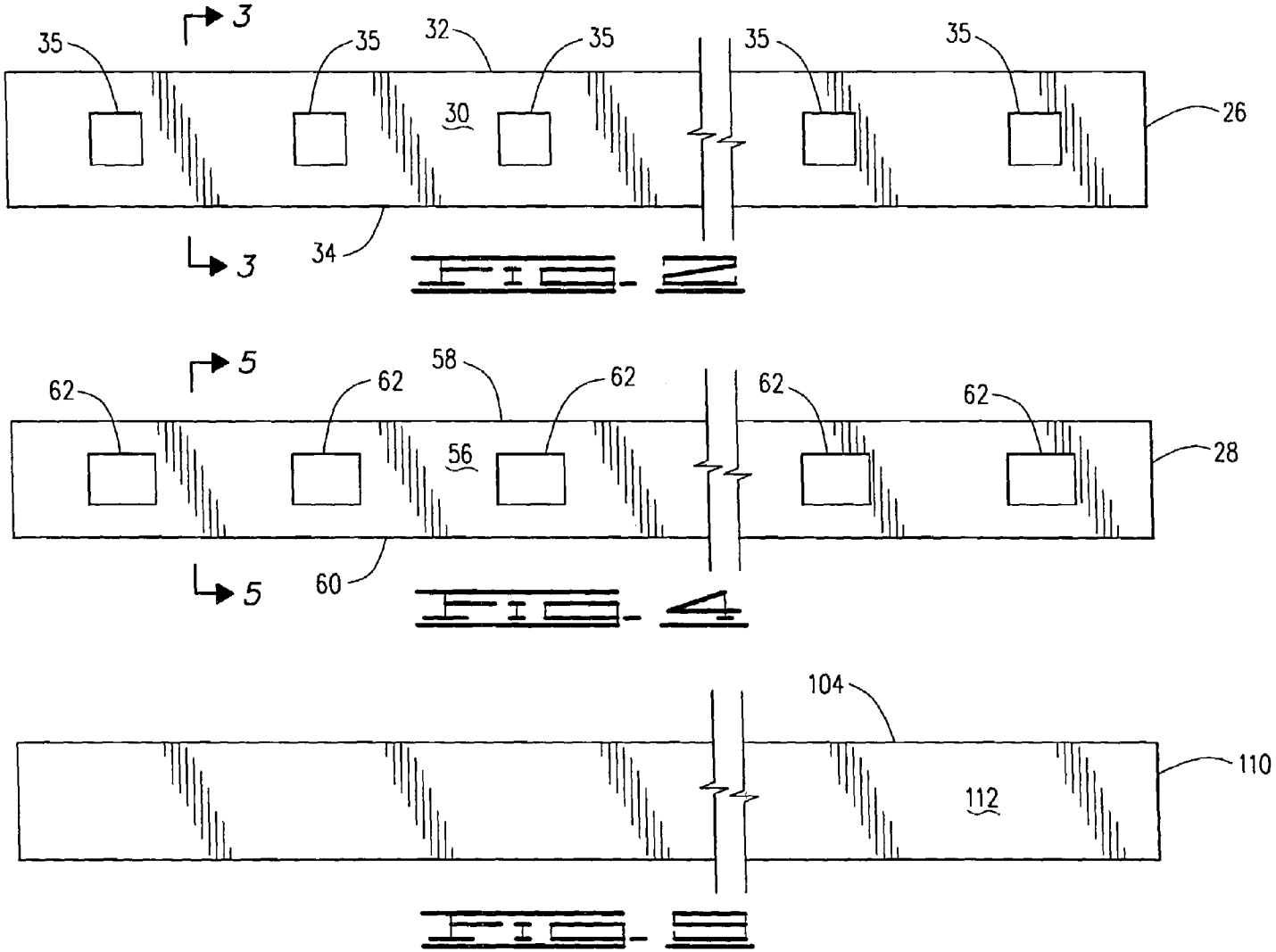
FIG. 2 is a top plan view showing the channel element of the rail of the present invention.
Figure 3:
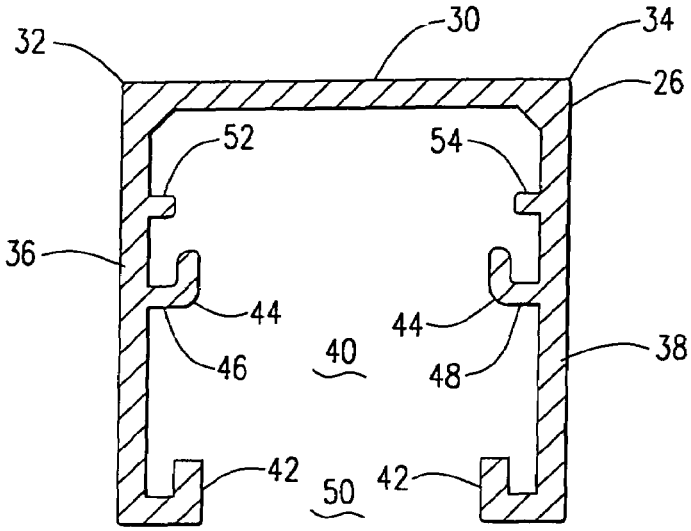
FIG. 3 is a cross-sectional view of the channel element shown in FIG. 2, taken along line 3—3.

With reference to FIGS. 2 and 3, the channel element 26 comprises an elongate structure having a generally U-shaped cross section. The channel element 26 is characterized by a elongate planar platform 30 having a first lateral edge 32 and an opposed second lateral edge 34. A plurality of collinear, longitudinally spaced, picket openings 35 are formed in the platform 30.

A first side wall 36 depends from the first lateral edge 32, and a second side wall 38 depends from the second lateral edge 34. The platform 30 and side walls 36 and 38 define boundaries of a rail channel 40. The first and second side walls 36 and 38 are preferably disposed in parallel planes, with each orthogonal to the plane of the platform 30. Preferably, the base of each of the side walls 36 and 38 is provided with an inturned flange section 42 positioned within the rail channel 40. Each flange section 42 is preferably characterized by a L-shaped cross section, and functions to enhance the strength of the channel element 26.

As best shown in FIG. 3, the channel element 26 further comprises a tray holder 44 adapted to slidably support a tray element 28 within the rail channel 40. The tray holder 44 preferably comprises a first runner element 46 projecting within the rail channel 40 from the first side wall 36, and a second runner element 48 projecting within the rail channel 40 from the second side wall 38. The runner elements are adapted to slidably receive and support a tray element 28 within the rail channel 40, and further function to restrain movement of the tray element 28 away from the platform 20 towards the mouth 50 of the rail channel 40.

Each of the runner elements 46 and 48 preferably each comprises an elongate flange having a L-shaped cross section. Each such flange preferably extends continuously and linearly along substantially the entire length of the channel element 26. Alternately, either or both of the runner elements 46 and 48 may comprise a series of spaced collinear flanges, rather than a single elongate flange. The first and second runner elements 46 and 48 should be equidistant from the platform 20.

With continued reference to FIG. 3, the tray holder 44 preferably further comprises a first stop element 52 projecting within the rail channel 40 from the first side wall 36, and a second stop element 54 projecting within the rail channel 40 from the second side wall 38. The stop elements 52 and 54 function to restrain movement of the tray element 28 toward the platform 20.

Each of the stop elements 52 and 54 preferably comprises an elongate rib which extends continuously and linearly along substantially the entire length of the channel element 26, in spaced relationship to an adjacent runner element. Alternately, either or both of the stop elements may comprise a series of spaced collinear ribs, rather than a single elongate rib. The stop elements 52 and 54 should be equidistant from the platform 20, with each stop element situated nearer the platform 20 than its adjacent runner element.

The runner elements 46 and 48, and the stop elements 52 and 54 cooperate to define a cage within which a tray element 28 may be slidably received and supported. While permitting easy insertion or withdrawal of the tray element 28 from the channel element 26, this cage restricts movement by a received tray element 28 either toward or away from the platform 20.

Figure 4:
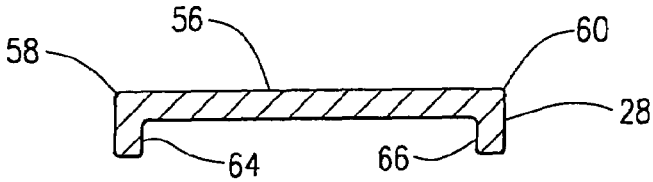
FIG. 4 is a top plan view showing the tray element of the rail of the present invention.
Figure 5:
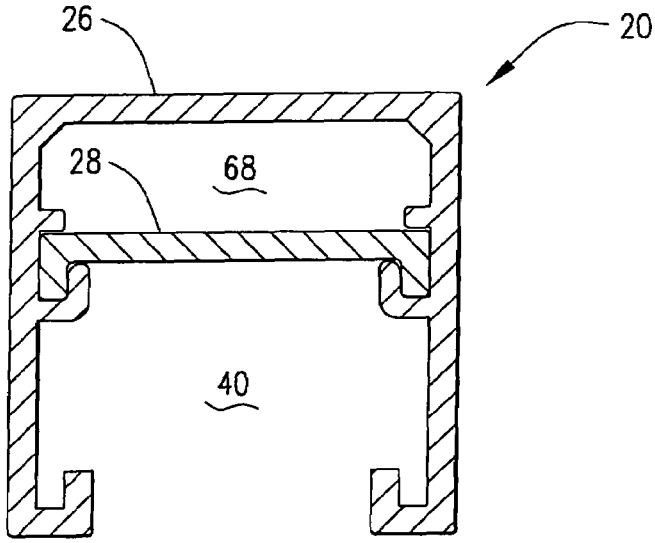
FIG. 5 is a cross-sectional view of the tray element shown in FIG. 4, taken along line 4—4.

With reference to FIGS. 4 and 5, the tray element 28 comprises an elongate planar platform 56 having a first lateral edge 58 and an opposed second lateral edge 60. The length of the platform 56 is preferably substantially the same as that of the platform 30 of channel element 26, while its width should permit the platform 56 to be clearingly received within the rail channel 40.

A plurality of collinear, longitudinally spaced, picket openings 62 are formed in the platform 56. The picket openings 62 are preferably disposed so that, when the tray element 28 is installed in the channel element 26, the center of each picket opening 62 is aligned with the center of a corresponding picket opening 35 formed in the channel element 26, such that the line of alignment between the two centers is orthogonal to the planes of the platform 30 and platform 56.

As shown in FIG. 5, the tray element 58 further comprises a first leg 64, which depends from the first lateral edge 58 of the platform 56, and a second leg 66 which depends 66 from the second lateral edge 60. The first and second legs 64 and 66 are preferably disposed in parallel planes, with each orthogonal to the plane of the platform 56. As shown in FIG. 6, the platform 56 and first and second legs 64 and 66 are sized to be clearingly received within the rail channel 40, and within the cage defined by the runner elements 46 and 48 and stop elements 52 and 54.

In one preferred embodiment of the rail 20, the channel element 26 is characterized by a substantially square profile, with the platform 20, first side wall 36 and second side wall 38 each having a width of 1.75 inches. The typical wall thickness of the tray element 28 in this embodiment is 0.12 inches. In the same embodiment, the width of the platform 56 of the tray element 26 is 1.481 inches, while the overall height of the tray element 26, comprising the distance between the upper surface of the platform 56 and the base of either of the legs 64 and 66, is 0.25 inches. The typical wall thickness of the tray element 28 in this embodiment is 0.08 inches.

With continued reference to FIG. 6, the rail 20 is assembled by sliding the tray element 28 into the tray holder 44 of the channel element 26, until the entire length of the tray element 28 is within the rail channel 40. In this installed position of the tray element 28, the platform 56 of tray element 28, and the platform 30 of channel element 26, define boundaries of a retainer channel 68. The retainer channel 68 is situated within the rail channel 40, and extends along the length thereof adjacent the platform 30. The portion of each of the side walls 36 and 38 which extends between the platforms 30 and 56 forms an additional boundary for the retainer channel 68.

Figure 7:
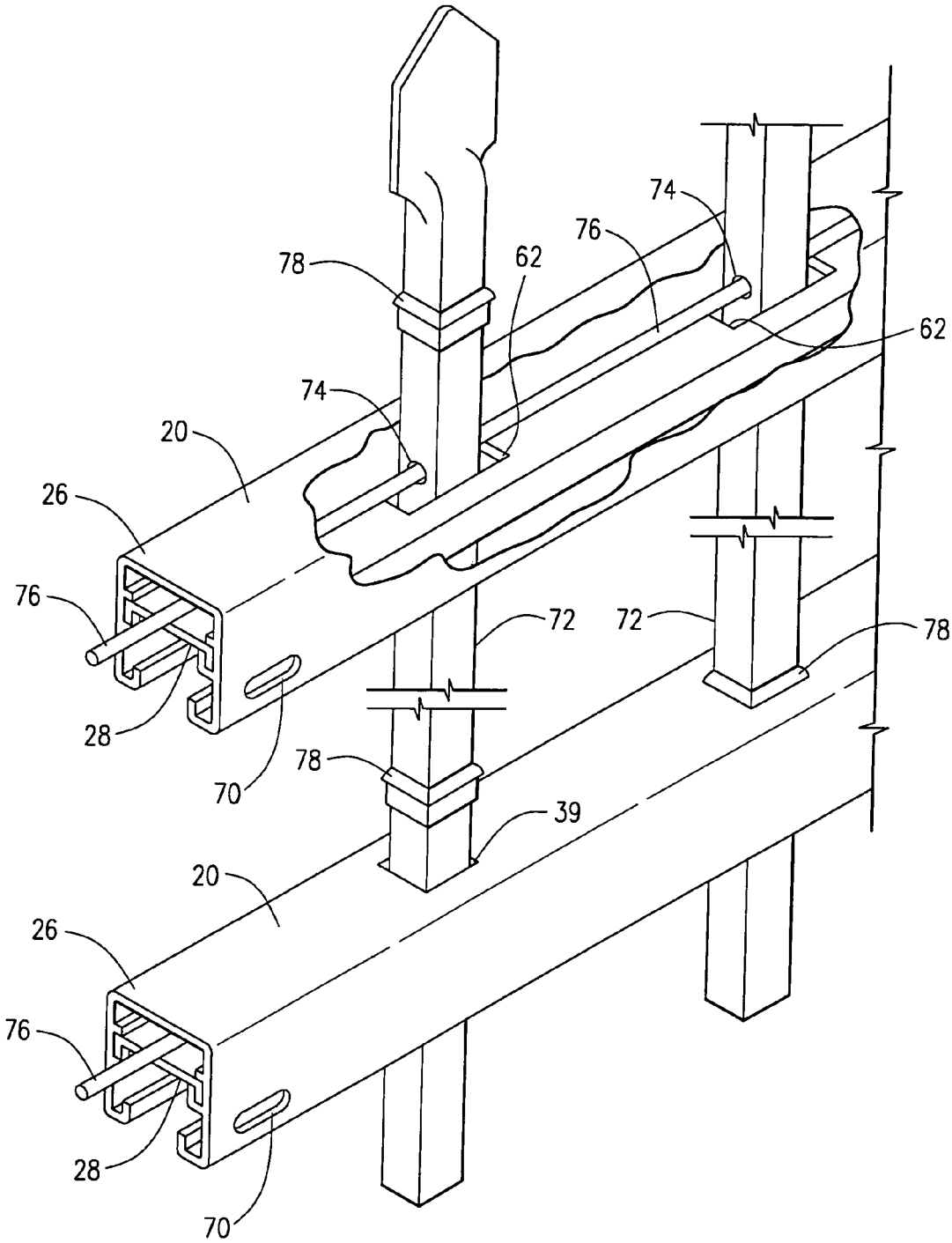
FIG. 7 is a perspective view of a partial section of fence which includes two rails of the present invention. The channel element of the upper rail has been partially cut away, in order to display other components of the fence. The pickets and rails have been shown fragmentarily to indicate indeterminate length. Grommets on the left-hand picket have been shown in an unseated position, to better display other components. The retainer element in each rail is not fully installed within the rail, to better illustrate the assembly process.
Figure 3:
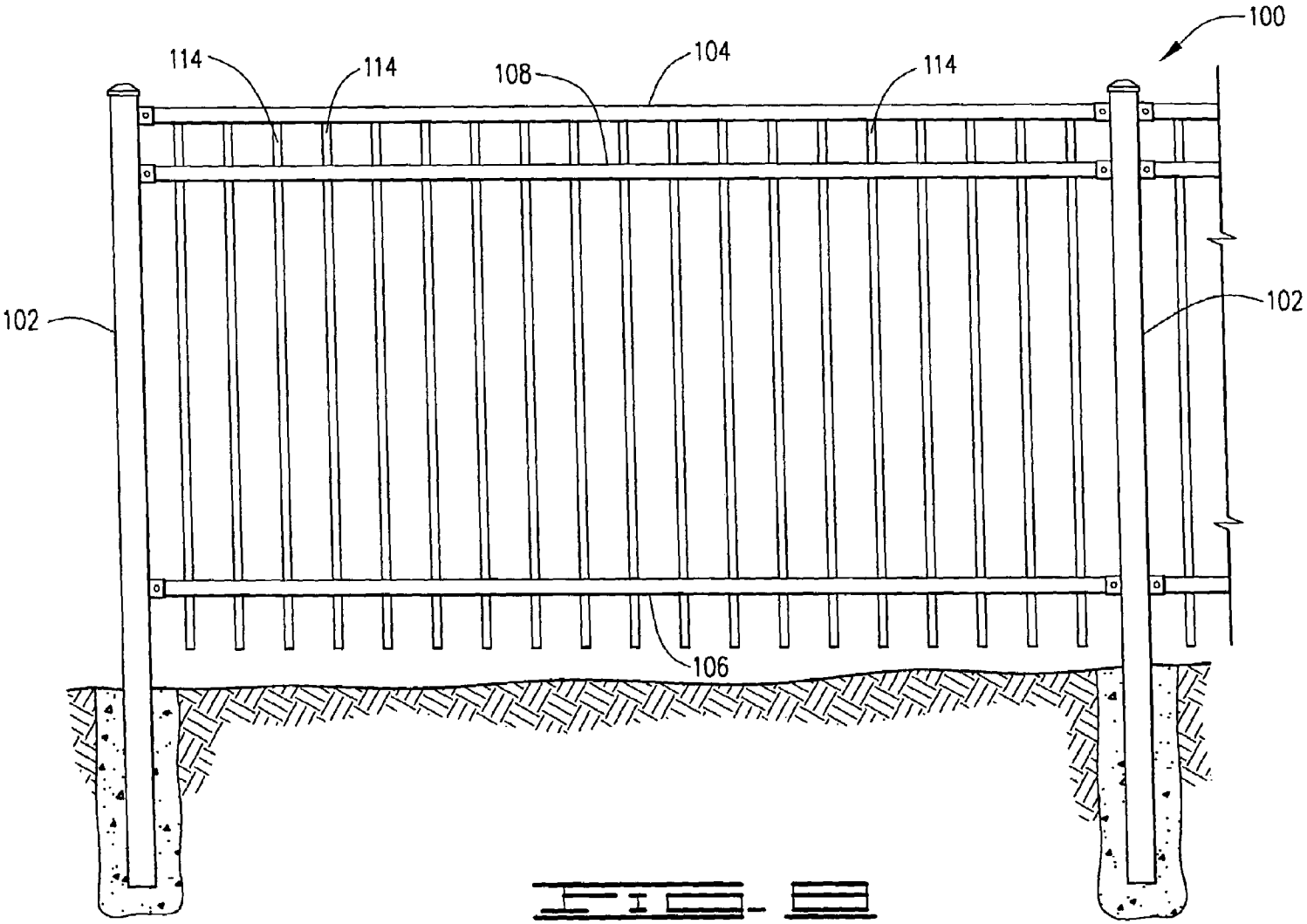

In an installed position, each of the assembled rails 20 extends between an adjacent pair of posts 16 comprising a section of the fence 10, as shown in FIG. 1. Two brackets 22 are used to connect the respective ends of a rail 20 to a pair of adjacent posts 16. Each bracket 22 is connected to the rail 20 by a fastener (not shown), such as a bolt or a screw. This fastener preferably extends through an aperture (not shown) in the bracket 22, and through a registering aperture 70 formed in a side wall of the rail 20, as shown in FIG. 7.

At least two rails 20 extend between each adjacent pair of posts 16. While any plural number of rails may be provided for each section, either two rails, as shown in FIG. 1, or three rails, as shown in FIG. 9, are preferred. The length of each rail 20 should be sufficient to fully span the distance between the adjacent of pair of posts 16 which will support that rail 20. A rail length of either 6 feet or 8 feet is preferred.

The rails 20 which extend between a given pair of posts are preferably disposed in parallel relationship. The incline of each rail 20 with respect to horizontal should substantially equal the incline of the terrain 24 on which pair of posts 16 supporting that rail 20 are installed. Thus, when a section 12 is positioned on horizontal terrain, as shown in FIG. 1, the rails 20 will be disposed substantially horizontally.

With continued reference to FIGS. 1 and 2, each section of the fence 10 further comprises a plurality of vertically disposed pickets 72, preferably of identical construction. Each picket 72 is preferably formed from a strong and durable material, and more preferably from a material which is relatively lightweight and extrudable as well. Preferred materials include aluminum, aluminum alloys, and plastics such as polyvinyl chloride. One particularly preferred material is 6063-T6 aluminum alloy. Preferably, the picket 72 is formed in a die by an extrusion process. After the picket 72 has been formed, a polyester powder coating is preferably provided in order to enhance corrosion resistance.

Each picket 72 is tubular in construction, and preferably is characterized by a rectangular or, most preferably, a square cross-section. The picket 72 may be hollow, or may include a core or other structure to increase its strength. The cross-sectional dimensions of the picket 72 should permit it to be clearingly received through the picket openings 35 and 62. In a preferred embodiment, the side walls of picket 72 are characterized by a thickness of 0.05 inches, and a width of 0.75 inches. As shown in FIGS. 1 and 7, the upper end of each picket 72 may be provided with a pointed or sharpened top, such as a spear or spike, as shown in FIG. 1. Alternately, each picket 72 may be provided with a flat or rounded top.

The length of each picket 72 is preferably approximately equal to the vertical above-ground height of the posts 16. In preferred embodiments, each picket will have a length between 45 inches and 72 inches. In an installed position, the base of each picket 72 should preferably be situated no more than a small distance above the terrain 24 supporting the fence 10, in order to prevent an intruder from traversing the gap between the base of the picket 72 and the terrain 72.

The pickets 72 are preferably oriented in parallel relationship, with a separation distance between adjacent pickets 72 and between each post 16 and its adjacent picket 72, which is sufficiently small to prevent an intruder from traversing the gap. In one preferred embodiment, the separation distance between the centers of adjacent pickets 72, and between each post 16 and its adjacent picket 72, is 4 inches or less. Between adjacent pairs of posts 16, pickets 72 should be provided in sufficient number to assure that the separation distance between adjacent pickets 72, or between a post 16 and an adjacent picket 72, does not exceed the requisite distance.

With reference to FIG. 7, each picket 72 to be installed in a section of the fence 10 should be laterally traversed by a plurality of parallel, longitudinally offset, retainer passages 74. The number of retainer passages 74 in each picket 72 preferably equals the number of rails 20 in the section. The relative position, orientation and size of each of the retainer passages 74 in each of the pickets 72 should be identical.

Each retainer passage 74 should cross the longitudinal axis of symmetry of the picket 72, preferably along a path which is perpendicular to, and interconnects, two opposed sides of the picket 72. The retainer passages 74 should be positioned on the picket 72 such that each retainer passage 74 may be aligned with a corresponding retainer channel 68 of a rail 20 in the section of fence 10. The retainer passages 74 of a plurality of linearly aligned pickets 72 should be linearly alignable.

The present invention further comprises an elongate retainer element 76, shown in FIG. 7, which connects a plurality of pickets 72 to a rail 20. The retainer element 76 preferably comprises a rod formed from a strong a durable material, such as galvanized steel. The length of the retainer element 76 should be equal to, or slightly less than, the length of the rail 20. In one preferred embodiment, the length of the retainer element 76 is between 0.75 inches and 2.00 inches less than the length of the rail 20. The cross-sectional dimensions of the retainer element 76 should permit it to be clearingly received within the retainer channel 68, and clearingly received within the retainer passage 74 of each picket 72. In a preferred embodiment, the retainer element 76 is characterized by a circular cross-section, and a diameter of 0.125 inches.

Pickets 72 are installed on a rail 20 by extending the picket 72 through an unoccupied picket opening 62 of the tray element 28, and through the aligned picket opening 35, if any, in the channel element 26, until the retainer channel 38 of the rail 20 is aligned with the retainer passage 74. This step is repeated for each additional picket 72 to be installed on the rail 20. The pickets 72 should be positioned on the rail 20 such that the retainer passages 74 of the pickets 72 are in linear alignment, as shown in FIG. 7. Once all pickets 72 have been positioned as required, a retainer element 76 is inserted into the retainer channel 68 and passed through the aligned retainer passages 74 of each of the pickets 72 to be installed on the rail 20.

As shown in FIG. 7, the fence 10 preferably comprises a plurality of grommets 78, which protect internal components of the fence 10 from water damage and corrosion. Each grommet 78 is seated in a picket openings 35, and fills the region between the platform 30 and the picket 72. The grommets 78 are preferably formed from a strong, flexible and water-resistant polymer, such as polyvinyl chloride, and are provided in a number equal to the number of picket openings 35 in the section. The grommets 78 are preferably installed by seating them in the picket openings of each rail 20 before installation of the pickets 72 into that rail. The final seated placement of a grommet 78 in the assembled fence 10 is shown at the right-hand picket of FIG. 7.

After the pickets 72 comprising a section of fence 10 have been installed on a first rail 20, as described above, the same steps should be repeated for each additional rail 20 which will support the same pickets 72. The result of this series of steps is a rail-picket framework. This rail-picket framework is then formed into a section of fence by securing each rail 20 of the framework at its opposite ends to an adjacent pair of posts 16, as shown in FIG. 1. Additional sections of the fence 10 may be formed and installed by repeating these steps.

As shown in FIGS. 2 and 4, the length of each picket opening 62 formed in the tray element 28 preferably exceeds the length of the adjacent picket opening 35 with which it registers. The greater length of the picket openings 62 permits the pickets 72 to be positioned in a vertical orientation, even when the rails 20 are not horizontal, as may occur when the fence 10 is installed on non-horizontal terrain.

The picket-rail attachment in the fence 10 of the present invention is situated within the rail channel 40, and thus is not exposed to the external environment. In addition to its aesthetic advantages, this internal connection promotes security, by denying an intruder or vandal any practical way of prying a picket 72 away from the rails 20. At the same time, the retainer elements 76 and retainer channels 68 function much like latches, and prevent the pickets 72 from being forcibly withdrawn from the picket openings 35 and 62. Because it is not exposed to the elements, the internal picket-rail connection is also less susceptible to corrosion and water damage.

FIG. 8 shows another embodiment of the fence of the present invention, generally designated by reference number 100. Much as with the embodiment described with reference to FIGS. 1–7, each section of the fence 100 is formed a pair of adjacent vertical posts 102, which support a plurality of parallel rails therebetween. The fence 100 comprises at least an upper rail 104 and a lower rail 106. Preferably, the fence 100 further comprises an intermediate rail 108, situated between upper rail 104 and lower rail 106. The lower rail 106 and intermediate rail 108 are identical in construction to the rail 20 described with reference to FIGS. 1–7.

The upper rail 104 is formed from a channel element 110 and a tray element (not shown). The channel element 110 is identical to the channel element 26, except that its platform 112 is unperforated, with no picket openings formed therein, as shown in FIG. 9. Because of absence of picket openings in the platform 112, the pickets 114 of the fence 100 terminate within the rail channel of the upper rail 104, as shown in FIG. 8, and no grommets are used. In contrast, in the fence 10 shown in FIG. 1, the pickets 72 terminate above the upper rail 20. Other aspects of the construction and assembly of the upper rail 104, including the tray element, and fence 100, are identical to those described with reference to rail 20 and fence 10.

The fence of the present invention may be assembled from, and the methods of the invention advantageously practiced with, a kit. The kit of the present invention preferably comprises a plurality of posts, preferably identical to the posts 16. The posts 16 are preferably provided in a number sufficient to form the fence, or section thereof, to be installed.

The kit further comprises a plurality of rails 20, with each rail 20 including a channel element 26, a tray element 28 and a retainer element 76. The rails 20 should be provided in the kit in a number sufficient to form the fence, or section thereof, to be installed. The kit should further comprise a plurality of brackets 22 and fasteners should for securing each rail 20 to an adjacent pair of posts 16. The brackets and fasteners are preferably provided in a number sufficient to form the fence, or section thereof, to be installed.

The kit further comprises a plurality of pickets, preferably identical to the pickets 72, preferably in a number sufficient for the fence, or section thereof, to be installed.

Changes may be made in the construction, operation and arrangement of the various parts, elements, steps and procedures described herein without departing from the spirit and scope of the invention as defined in the following claims.

What is claimed is:

1. A rail comprising:

a channel element comprising:

a platform having opposed first and second lateral edges;

a first side wall which depends from the first lateral edge of the platform; and a second side wall which depends from the second lateral edge of the platform;

in which the platform and the first and second side walls define boundaries of a rail channel, and:

a tray holder adapted to support a separate tray element within the rail channel, while restricting its movement toward or away from the platform; and a separate tray element comprising an integral member having substantially the same length as the platform of the channel element, the tray element supportable on the tray holder, with the installed tray element and the channel element defining boundaries of a retainer channel.

2. The rail of claim 1 in which the tray holder further comprises:

a pair of runner elements formed on opposite side walls and adapted to slidably receive and support a tray element.

3. The rail of claim 2 in which the tray holder further comprises:

a pair of stop elements formed on opposite side walls and adapted to restrict movement by a tray element toward the platform.

4. The rail of claim 1 in which the platform of the channel element is characterized as having a plurality of longitudinally spaced picket openings formed therein.

5. The rail of claim 1, further comprising:

an elongate retainer element receivable within the retainer channel.

6. The rail of claim 1 in which the tray element is characterized as having a plurality of longitudinally spaced picket openings formed therein.

7. The rail of claim 1 in which the platform of the channel element is characterized as having a plurality of longitudinally spaced picket openings formed therein, and in which the tray element is characterized as having a plurality of longitudinally spaced picket openings formed therein, and in which each picket opening of the channel element is registrable with a corresponding picket opening in the tray element.

8. A fence comprising a plurality of rails, as defined in claim 5, and further comprising:

a plurality of vertically disposed posts, with each adjacent pair of posts supporting the opposite ends of a plurality of rails; and a plurality of pickets, with each picket being laterally traversed by at least one retainer passage;

in which the retainer element of each rail is positioned within the retainer channel such that it passes through the aligned retainer passages of the pickets.

9. A kit comprising a plurality of rails as defined in claim 1, and further comprising:

a plurality of posts; and a plurality of pickets.

10. A kit comprising a plurality of rails as defined in claim 5, and further comprising:

a plurality of posts; and a plurality of pickets.

11. A method of making a rail as defined in claim 1, comprising:

forming the channel element from an extrudable material by an extrusion process; and forming the tray element from an extrudable material by an extrusion process.

12. The method of claim 11 in which the extrudable material comprises aluminum.

13. A method of assembling a fence as defined in claim 8, comprising:

installing a plurality of pickets into a rail, such that the retainer passages of the pickets are aligned at the retainer channel;

inserting the retainer element into the retainer channel, and through the aligned retainer passages of the installed pickets;

repeating the preceding steps for each additional rail which will support the pickets; and securing each rail at its opposite ends to an adjacent pair of posts.

14. The rail of claim 5 in which the length of the retainer ment is substantially the same as the length of the rail.

15. The rail of claim 6, further comprising:

an elongate retainer element receivable within the retainer channel.

16. The rail of claim 15 in which the length of the retainer ment is substantially the same as the length of the rail.

17. A fence comprising a plurality of rails, including at least one rail as defined in claim 15, and further comprising:

a plurality of vertically disposed posts, with each adjacent pair of posts supporting the opposite ends of a plurality of rails; and a plurality of pickets, with each picket being laterally traversed by at least one retainer passage;

in which the retainer element of each rail defined as in claim 15 is positioned within the retainer channel such that it passes through the aligned retainer passages of the pickets.

18. The fence of claim 17 in which the rails are of identical construction.

19. A kit comprising a plurality of rails as defined in claim 6, and further comprising:

a plurality of posts; and a plurality of pickets.

20. A kit comprising a plurality of rails as defined in claim 15, and further comprising:

a plurality of posts; and a plurality of pickets.

21. A rail comprising:

an channel element comprising:

a platform having opposed first and second lateral edges;

a first side wall which depends from the first lateral edge of the platform;

a second side wall which depends from the second lateral edge of the platform;

in which the platform and the first and second side walls define boundaries of a rail channel having an open mouth, and:

a tray holder, adapted to support a separate tray element within the rail channel at a position spaced from the mouth thereof, a separate tray element comprising an integral member having substantially the same length as the platform of the channel element, tray element supportable on the tray holder, with the installed tray element and the channel element defining boundaries of a retainer channel.

22. The rail of claim 21 in which the platform of the channel element is characterized as having a plurality of longitudinally spaced picket openings formed therein.

23. The rail of claim 21, further comprising:

a tray element supportable on the tray holder, with the installed tray element and the channel element defining boundaries of a retainer channel.

24. The rail of claim 23, further comprising:

an elongate retainer element receivable within the retainer channel.

25. The rail of claim 23 in which the tray element is characterized as having a plurality of longitudinally spaced picket openings formed therein.

26. The rail of claim 21 in which the platform of the channel element is characterized as having a plurality of longitudinally spaced picket openings formed therein, and in which the tray element is characterized as having a plurality of longitudinally spaced picket openings formed therein, and in which each picket opening of the channel element is registrable with a corresponding picket opening in the tray element.

27. A fence comprising a plurality of rails, as defined in claim 24, and further comprising:

a plurality of vertically disposed posts, with each adjacent pair of posts supporting the opposite ends of a plurality of rails; and a plurality of pickets, with each picket being laterally traversed by at least one retainer passage;

in which the retainer element of each rail is positioned within the retainer channel such that it passes through the aligned retainer passages of the pickets.

28. The fence of claim 27 in which the rail channels of the rails open in the same downward direction.

29. A kit comprising a plurality of rails as defined in claim 21, and further comprising:

a plurality of posts; and a plurality of pickets.

30. A kit comprising a plurality of rails as defined in claim 24, and further comprising:

a plurality of posts; and a plurality of pickets.

* * * * *